US011215001B2

(12) United States Patent
Cai

(10) Patent No.: US 11,215,001 B2
(45) Date of Patent: Jan. 4, 2022

(54) POSITIONABLE HIDDEN HYDRAULIC HINGE

(71) Applicant: NINGBO PENTAGON DAMPER CO., LTD, Zhejiang (CN)

(72) Inventor: Fuyong Cai, Ningbo (CN)

(73) Assignee: NINGBO PENTAGON DAMPER CO., LTD, Ningbo (CN)

( * ) Notice: Subject to any disclaimer, the term of this patent is extended or adjusted under 35 U.S.C. 154(b) by 112 days.

(21) Appl. No.: 16/694,701

(22) Filed: Nov. 25, 2019

(65) Prior Publication Data

US 2020/0087966 A1 Mar. 19, 2020

Related U.S. Application Data

(63) Continuation of application No. PCT/CN2018/114001, filed on Nov. 5, 2018.

(30) Foreign Application Priority Data

Dec. 26, 2017 (CN) ..... 201711436729.3

(51) Int. Cl.
*E05F 3/20* (2006.01)
*E05F 3/10* (2006.01)
*E05F 3/12* (2006.01)

(52) U.S. Cl.
CPC ..... *E05F 3/20* (2013.01); *E05F 3/104* (2013.01); *E05F 3/108* (2013.01); *E05F 3/12* (2013.01);
(Continued)

(58) Field of Classification Search
CPC ... D05F 3/20; D05F 3/10; D05F 3/104; D05F 3/106; D05F 3/108; D05F 3/12;
(Continued)

(56) References Cited

U.S. PATENT DOCUMENTS 109,962 A * 12/1870 Stafford ..... E05F 3/108 16/71
897,825 A * 9/1908 Flynn ..... E05F 3/108 16/61

(Continued)

FOREIGN PATENT DOCUMENTS

CN 2343291 Y 10/1999
CN 206329200 U 7/2017

(Continued)

OTHER PUBLICATIONS

International Search Report issued in PCT/CN2018/114001 dated Jan. 21, 2019, with English translation.

(Continued)

*Primary Examiner* — Emily M Morgan
(74) *Attorney, Agent, or Firm* — Millburn IP PLLC

(57) ABSTRACT

A positionable hidden hydraulic hinge configured for installation of a door is provided. The positionable hidden hydraulic hinge includes a non-movable device body configured to be connectable with a door frame, a rotatable device body configured to be connectable with a door leaf, and a hinge configured to connect the non-movable device body and the rotatable device body. The rotatable device body includes a bearing guiding base having a guiding groove and a hydraulic chamber body. The positionable hidden hydraulic hinge also includes a linkage assembly configured to penetrate throughout the hinge. Two ends of the linkage assembly are configured to pivotably connect with the non-movable device body and an internal mechanism of the rotatable device body, respectively. A first end of the bearing guiding base is fixedly connected with the hinge, and a second end of the bearing guiding base is connected with the hydraulic chamber body.

12 Claims, 6 Drawing Sheets

(52) U.S. Cl.
CPC ..... *E05Y 2600/41* (2013.01); *E05Y 2900/132* (2013.01)

(58) Field of Classification Search
CPC ..... E05F 3/20; E05F 3/10; E05F 3/104; E05F 3/106; E05F 3/108; E05F 3/12
USPC ..... 16/66, 49
See application file for complete search history.

(56) References Cited

U.S. PATENT DOCUMENTS 1,962,291 A * 6/1934 Anderson ..... E05F 3/00 59/78
3,372,427 A * 3/1968 Koivusalo ..... E05F 3/108 16/68
5,956,806 A * 9/1999 Tutikawa ..... E05F 3/02 16/66
2004/0111831 A1* 6/2004 Foster ..... E05F 3/108 16/69
2007/0186375 A1* 8/2007 Luca ..... E05F 3/108 16/72
2009/0241287 A1* 10/2009 Reid ..... E05F 3/108 16/58
2011/0283478 A1* 11/2011 Berry ..... F16F 6/005 16/54
2012/0198654 A1* 8/2012 Reid ..... E05F 3/12 16/52
2019/0136596 A1* 5/2019 Tassi ..... E05F 3/10
2020/0011110 A1* 1/2020 Boundy ..... B23B 49/023
2020/0123828 A1* 4/2020 Reid ..... E05F 1/105

FOREIGN PATENT DOCUMENTS

CN 108166878 A 6/2018
CN 207749960 U 8/2018

OTHER PUBLICATIONS

Written Opinion issued in PCT/CN2018/114001 dated Jan. 21, 2019, with English translation.

* cited by examiner

POSITIONABLE HIDDEN HYDRAULIC HINGE

CROSS-REFERENCE TO RELATED APPLICATIONS

This application is a continuation of International Application No. PCT/CN2018/114001, filed Nov. 5, 2018, which claims priority to Chinese Patent Application No. 201711436729.3, filed on Dec. 26, 2017, the entire contents of both of which are incorporated herein by reference.

TECHNICAL FIELD

The present disclosure relates to door body accessories and, more particularly, to a positionable hidden hydraulic hinge configured to connect a door leaf with a door frame.

BACKGROUND TECHNOLOGY

The accessory that connects the door leaf with the door frame and that has an automatic door closing function is referred to as a door closer. Currently, the door closer used for a room door is often installed at the back of the room door, which is also referred to as an exposingly installed door closer, such as a damping hinge disclosed in patent number 201610744065 published by the Chinese national patent office. The disadvantages of such a door closer include: 1. not aesthetically pleasing, and tending to ruin the overall effect of the room door; 2. an exposed part of such type of a door closer has a safety risk for a child in the family; 3. the room door is often not fully closed due to design issues. On the other hand, traditional mechanical hinges, although installed in a hidden manner, cannot achieve the effect of gradual door closing, and do not have a positioning function. It is very inconvenient to use when the door cannot be positioned after being opened. In the current market, although some hydraulic hinges have a hydraulic buffer function, they are all designed for exposed installations, with the hydraulic part configured in a shaft, and the hinge shaft is relatively thick and large. Such a configuration not only has a complex structure, and a short lifetime, but also affects the aesthetics of the door and does not provide a certain degree of fire retardance.

SUMMARY

The main technical issue to be addressed by the present disclosure is, to provide a positionable hidden hydraulic hinge, which has a simple structure, and is safe to use.

To solve the above technical issues, the present disclosure provides a positionable hidden hydraulic hinge, which includes a non-movable device body configured to be connectable with a door frame, a rotatable device body configured to be connectable with a door leaf, and a hinge configured to connect the non-movable device body and the rotatable device body. The positionable hidden hydraulic hinge also includes a linkage assembly. A positioning mechanism and a hydraulic pressure-resisting mechanism are disposed inside the rotatable device body. The linkage assembly is configured to penetrate throughout the hinge to respectively pivotably connect, at two ends, with the non-movable device body and an inner mechanism of the rotatable device body.

In some embodiments, the non-movable device body and the rotatable device body are configured to be respectively buried (or concealed) in the door frame and the door leaf.

In some embodiments, a positionable hidden hydraulic hinge of the present disclosure includes a hinge, a non-movable device body configured to be connectable with the hinge, and a rotatable device body and a linkage assembly configured to be connectable with the hinge. The non-movable device body and the rotatable device body are configured to be respectively buried in a side edge frame of the room door and a corresponding door frame of the room door. The rotatable device body is provided with a positioning mechanism and a hydraulic pressure-resisting mechanism. The linkage assembly is configured to be connectable with the non-movable device body and the rotatable device body.

In some embodiments, the non-movable device body includes a curved rod fixing base, the curved rod fixing base is configured to be fixedly connectable with the hinge.

In some embodiments, the rotatable device body includes a bearing guiding base, and a hydraulic chamber body. The bearing guiding base is configured to be fixedly connectable with the hinge. The hydraulic chamber body is configured to be fixedly connectable with the bearing guiding base. An interior of the hydraulic chamber body is provided with an end cover of the chamber body, a sealing sleeve of a piston rod, a piston, and a spring.

In some embodiments, the linkage assembly includes a curved rod, a connecting rod, and a bearing. The curved rod is configured to be connectable with the curved rod fixing base through a pin. The connecting rod is configured to be connectable with the curved rod through a pin. Two connecting ends of the connecting rod and the curved rod are respectively provided with a bearing.

The advantages of the present disclosure include: a positionable hidden hydraulic hinge includes a non-movable device body configured to be connectable with a door frame, a rotatable device body configured to be connectable with a door leaf, and a hinge configured to be connectable with the non-movable device body and the rotatable device body. The positionable hidden hydraulic hinge also includes a linkage assembly. A positioning mechanism and a hydraulic pressure-resisting mechanism are disposed inside the rotatable device body. The linkage assembly is configured to penetrate throughout the hinge to respectively pivotably connect, at two ends, with the non-movable device body and an inner mechanism of the rotatable device body. The disclosed structure is simple and compact, convenient for hidden installation, and safe to use.

DETAILED DESCRIPTION OF THE EMBODIMENTS

Next, the present disclosure will be explained in detail through specific embodiments in combination with the accompanying drawings.

Figure 1:
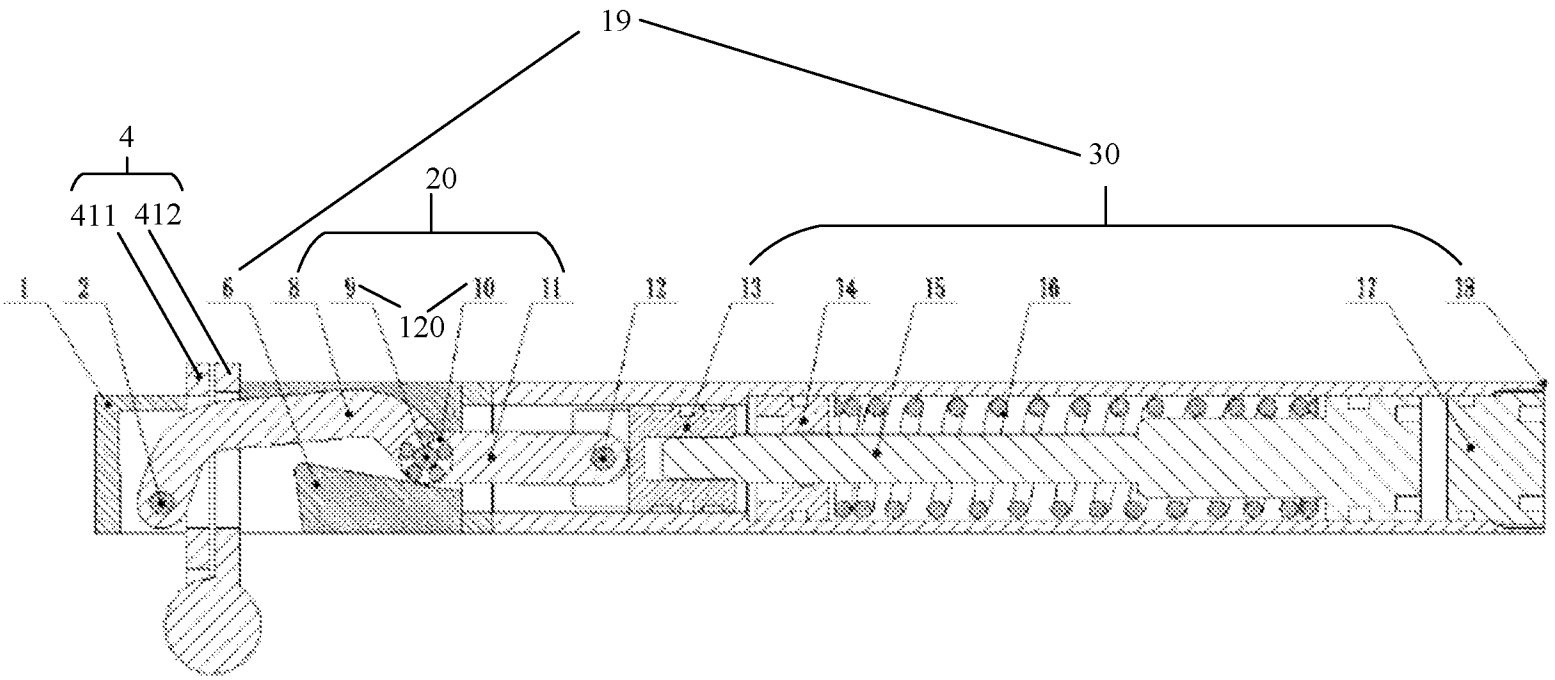
FIG. 1 is a cross-sectional view of an embodiment of the present disclosure.

Referring to FIG. 1 to FIG. 6, which show a positionable hidden hydraulic hinge, including a non-movable device body configured to be connectable with a door frame, a rotatable device body 19 (encompassing a bearing guiding base 6 and a hydraulic device 30) configured to be connectable with a door leaf, and a hinge 4 (including rotatable parts 411 and 412) configured to be connectable with the non-movable device body and the rotatable device body 19. The hydraulic device 30 may include a piston rod nut 13, a piston rod sealing sleeve 14, a piston rod 15, a spring 16, a chamber body end cover 17, and a hydraulic chamber body 18, as shown in FIG. 1. The positionable hidden hydraulic hinge also includes a linkage assembly 20. A positioning mechanism and a hydraulic pressure-resisting mechanism (also referred to as the hydraulic device 30) are disposed inside the rotatable device body 19. The linkage assembly 20 is configured to penetrate throughout the hinge 4 to respectively pivotably connect, at two ends, with the non-movable device body and an inner mechanism (or a portion) of the rotatable device body 19. As shown in FIG. 1, in one embodiment, the portion of the rotatable device body 19 may be the piston rod nut 13.

Figure 3:
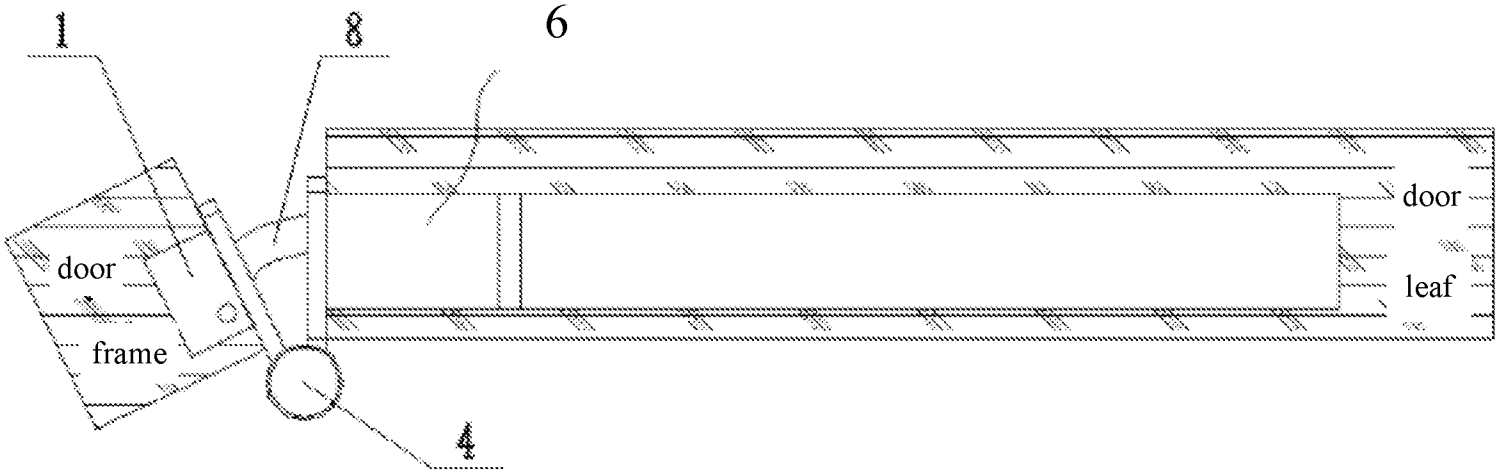
FIG. 3 is a schematic view of an operation state (door half opened) of the embodiment shown in FIG. 1.

During implementation, as shown in FIG. 3, the non-movable device body and the rotatable device body 19 are respectively configured to be capable of being buried in a door frame and a door leaf to achieve hidden or concealed installations.

Figure 4:
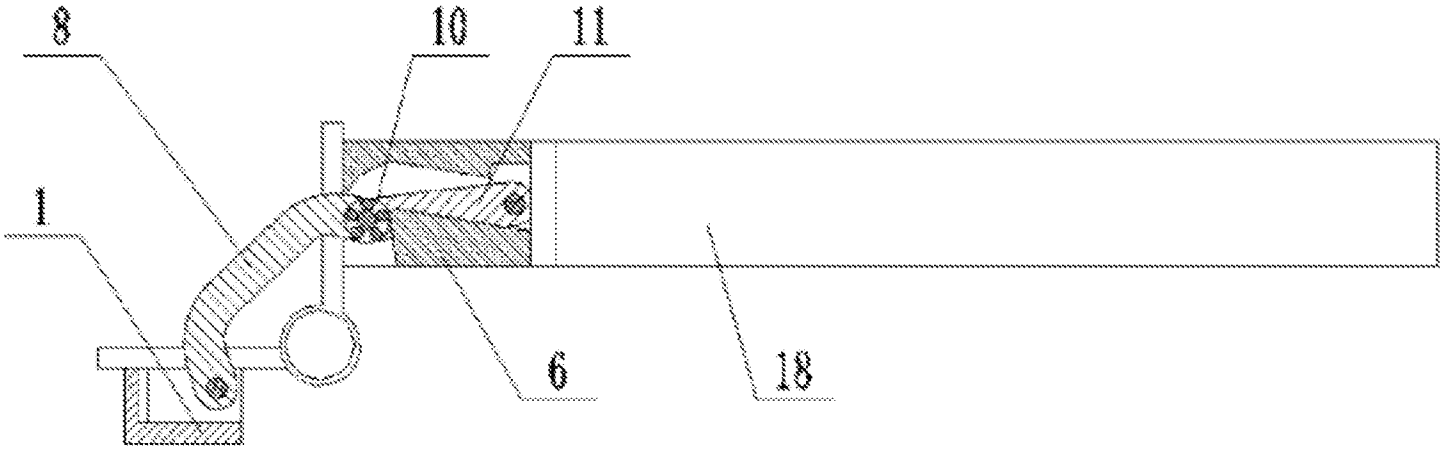
FIG. 4 is a schematic view of an operation state (door opened at 90 degrees) of the embodiment shown in FIG. 1.

As shown in FIG. 4, the linkage assembly 20 may include a curved rod 8 and a connecting rod 11 that are pivotably connected with one another. The non-movable device body may be a curved rod fixing base 1. The curved rod 8 of the linkage assembly 20 may be pivotably connected with the curved rod fixing base 1.

As shown in FIGS. 1, 2, 4, and 6, when implemented, the rotatable device body 19 may include the bearing guiding base 6 having a guiding groove 60 and the hydraulic device 30. An end of the bearing guiding base 6 may be fixedly connected with the hinge 4, the other end may be connected with the hydraulic chamber body 18. A middle segment 120 (including a pin 9 and a bearing 10) of the linkage assembly 20 may be embedded in the bearing guiding base 6. A portion of the connecting rod 11 that is pivotably connected with the curved rod 8 may be located in the guiding groove 60 of the bearing guiding base 6 and may be subject to a guiding function thereof. The other end of the connecting rod may be connected with the hydraulic chamber body 18.

As shown in FIGS. 1, 2, 4, and 6, when implemented, the linkage assembly 20 may specifically include the curved rod 8, the connecting rod 11, the bearing 10, and the pin 9. The curved rod 8 may be pivotably connected with the connecting rod 11 through the pin 9. At both ends of the pin 9, bearings 10 are mounted at an external side of the curved rod 8. The bearing 10 may cooperate with the guiding groove 60 of the bearing guiding base 6, thereby providing a guiding function to the portion of the connecting rod 11 that is pivotably connected with the curved rod 8.

Figure 6:
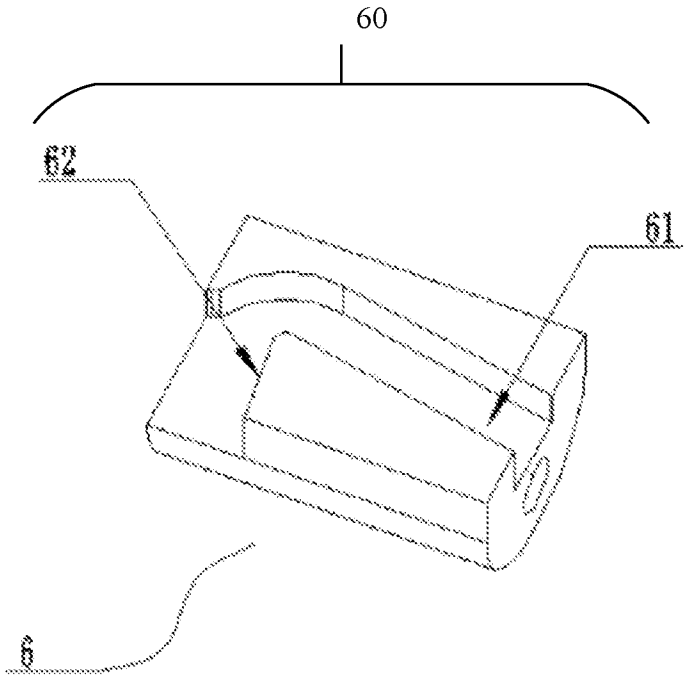
FIG. 6 is a schematic view of an inner structure of a bearing guiding base of an embodiment.

As shown in FIGS. 4 and 6, when implemented, the guiding groove 60 of the bearing guiding base 6 may include a main body portion 61 and a stepped surface 62 facing the direction of the curved rod fixing base 1. The stepped surface 62 may form a 60°-90° angle with the main body portion 61 of the guiding groove 60.

Figure 2:
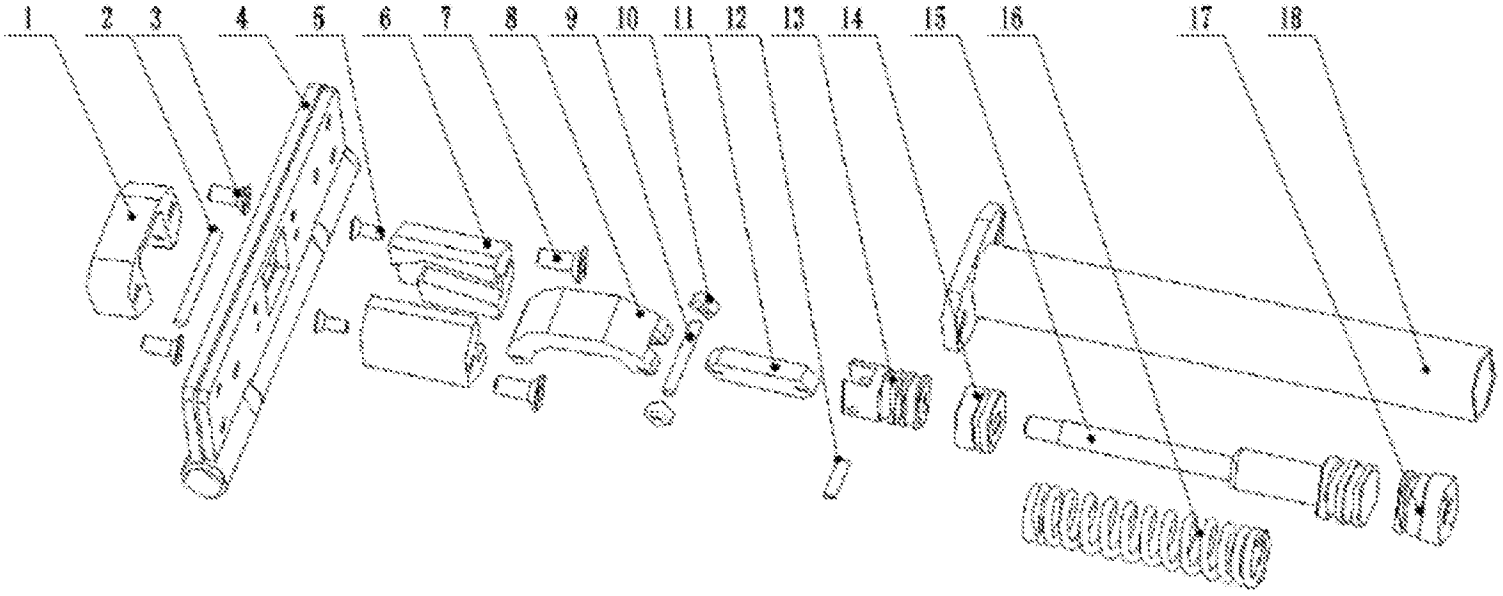
FIG. 2 is an exploded view of the embodiment shown in FIG. 1.
Figure 5:
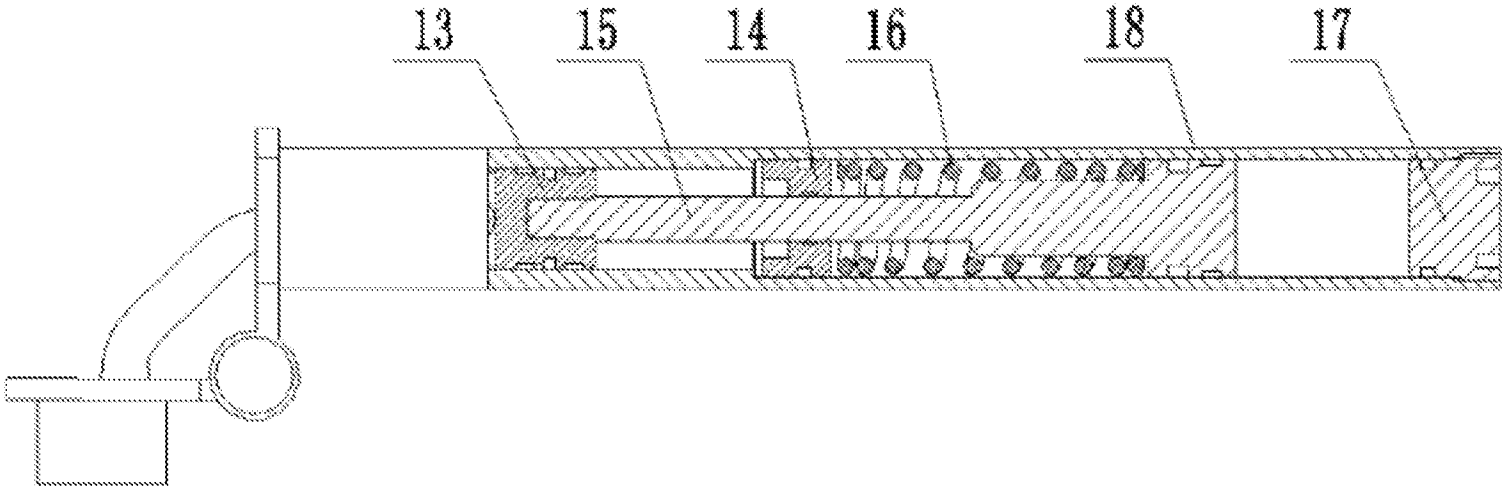
FIG. 5 is a cross-sectional view of another part of FIG. 4.

As shown in FIGS. 1, 2, and 5, when implemented, an interior of the hydraulic chamber body 18 may be provided with: the piston rod sealing sleeve 14, the piston rod 15 functioning as a piston, and the spring 16. After a main body of the piston rod 15 is sleeve-fit with the spring 16, an end of the rod body of the piston rod 15 may penetrate the piston rod sealing sleeve 14 to pivotably connect with the connecting rod 11. Under the pulling action of the connecting rod 11, the piston rod 15 may slide toward an external side of the piston rod sealing sleeve 14 while compressing the spring 16.

As shown in FIGS. 1, 2, and 5, when implemented, the chamber body end cover 17 may also be included. An external end portion of the hydraulic chamber body 18 may achieve sealing through coupling with the chamber body end cover 17.

As shown in FIGS. 1 and 2, when implemented, the piston rod nut 13 may be disposed between the connecting rod 11 and the piston rod 15. An end of the piston rod nut 13 may be pivotably connected with the connecting rod 11, the other end may be fixedly connected with the piston rod 15.

As shown in FIG. 1, when implemented, a resistant fluid (e.g., oil) may fill an inside of the hydraulic chamber body 18.

As shown in FIGS. 1 and 2, when implemented, the curved rod 8 may be pivotably connected with the curved rod fixing base 1 through a pin 2. The piston rod nut 13 may be pivotably connected with the connecting rod 11 through a pin 12.

As shown in FIGS. 1 and 2, when implemented, the hinge 4 and the curved rod fixing base 1 may be connected through a screw 3. The hinge 4 may be connected with the bearing guiding base 6 through a screw 5. The bearing guiding base 6 and the hydraulic chamber body 18 may be connected with a screw 7.

In a positionable hidden hydraulic hinge of the present disclosure, when implemented, as shown in FIGS. 3, 4, 5, and 6, the curved rod fixing base 1 may be securely mounted in a door frame, and fixed through the hinge 4. The rotatable device body 19 may be securely mounted in a door leaf, and fixed through the hinge 4. When the door is opened, the curved rod fixing base 1 may cause the linkage assembly 20 (including the curved rod 8 and the connecting rod 11 pivotably connected to a tail portion of the curved rod 8) to move along the guiding groove 60 on the bearing guiding base 6. The linkage assembly 20 may cause the piston rod nut 13 disposed inside the hydraulic chamber body 18 to move. The piston rod nut 13 may cause the piston rod 15 to move and to compress the spring 16 disposed at an upper end of the piston rod 15. When the linkage assembly 20 moves along with the opening of the door, the bearing 10 on the linkage assembly 20 may move upwardly until reaching the stepped surface 62 disposed at the tail portion of the guiding groove 60, to block the reciprocating movement of the linkage assembly 20, thereby achieving the positioning function. When the door is closed, the door is subject to an external force that pushes the door, which may cause the linkage assembly 20 to move, such that the bearing 10 on the linkage assembly 20 may be pushed off from the stepped surface 62 disposed at the tail portion of the guiding groove 60. At this moment, the compressed spring 16 may push the piston rod 15 to move. The piston rod 15 may cause the piston rod nut 13 to move. The piston rod nut 13 may cause the linkage assembly 20 to move along the guiding groove 60 disposed on the bearing guiding base 6. The linkage assembly 20 may cause the curved rod fixing base 1 to move such that the door is closed. When the door is closed, in the meantime, the piston (which is an end portion of the piston rod 15) inside the hydraulic chamber body 18 may move to generate a hydraulic resistance, such that the door can stably and gradually close.

The disclosed structure can achieve a hydraulic, internally disposed, hidden hinge that is positionable, which can automatically close the door, and which has a hydraulic buffer. Compared to existing technologies, because the presently disclosed device can be installed in a concealed or hidden manner, the overall effect of the room door installation is significantly enhanced. The structure is simple, reasonable, and the device performance is stable, the lifetime is long, and the cost is low. The device of the present disclosure is positionable, can automatically close the door, has a hydraulic buffer for anti-wind and anti-hand jamming, has a stable performance, long lifetime, and is useful and durable.

The above content is a further detailed description of the present disclosure with reference to specific embodiments. This cannot be interpreted as indicating that the specific embodiments of the present disclosure are only limited to these descriptions. A person having ordinary skills in the art can perform simple derivation or substitution without departing from the principle of the present disclosure, which should be regarded as being within the scope of protection of the present disclosure.

What is claimed is:

1. A positionable hidden hydraulic hinge, comprising:

a fixing base configured to be connectable with a door frame;

a rotatable device body configured to be connectable with a door leaf, the rotatable device body including: a bearing guiding base having a guiding groove; and a hydraulic device;

a hinge configured to connect with the fixing base and the rotatable device body; and a linkage assembly configured to penetrate throughout the hinge, wherein two ends of the linkage assembly are configured to pivotably connect with the fixing base and a portion of the rotatable device body, respectively, wherein a first end of the bearing guiding base is fixedly connected with the hinge, and a second end of the bearing guiding base is connected with the hydraulic device, wherein the guiding groove of the bearing guiding base includes a stepped surface configured to block a movement of the linkage assembly.

2. The positionable hidden hydraulic hinge of claim 1, wherein the linkage assembly includes a curved rod and a connecting rod that are pivotably connected, and wherein the curved rod of the linkage assembly is pivotably connected with the fixing base.

3. The positionable hidden hydraulic hinge of claim 1, wherein the hinge includes two rotatable parts with center holes, wherein the linkage assembly includes a curved rod and a connecting rod that is pivotably connected with the curved rod, and wherein the curved rod is configured to penetrate the center holes to connect with the fixing base.

4. The positionable hidden hydraulic hinge of claim 2, wherein a middle segment of the linkage assembly is embedded in the bearing guiding base, and wherein a portion of the connecting rod that is pivotably connected with the curved rod is located in the guiding groove of the bearing guiding base and is configured to move along the guiding groove.

5. The positionable hidden hydraulic hinge of claim 4, wherein the linkage assembly also includes a bearing and a pin, wherein the curved rod is pivotably connected with the connecting rod through the pin, wherein each external side of two ends of the pin is respectively mounted with the bearing, and wherein the bearing is engaged with the guiding groove of the bearing guiding base to provide a guiding function for the portion of the connecting rod pivotably connected with the curved rod.

6. The positionable hidden hydraulic hinge of claim 1, wherein the stepped surface faces a direction toward the fixing base, and wherein a portion of the stepped surface and a main body portion of the guiding groove form a 60°-90° angle.

7. The positionable hidden hydraulic hinge of claim 4, wherein the hydraulic device is provided with a hydraulic chamber body, a piston rod sealing sleeve, a piston rod functioning as a piston, and a spring, wherein a main body of the piston rod is sleeve fit with the spring, wherein an end of the piston rod is configured to penetrate the piston rod sealing sleeve to pivotably connect with the connecting rod, and wherein the piston rod is configured to slide toward an external side of the piston rod sealing sleeve while compressing the spring under a pulling action of the connecting rod.

8. The positionable hidden hydraulic hinge of claim 7, further comprising:

a chamber body end cover, wherein an external end portion the hydraulic chamber body is configured to couple with the chamber body end cover to achieve sealing.

9. The positionable hidden hydraulic hinge of claim 7, wherein the portion of the rotatable device body is a piston rod nut, which is provided between the connecting rod and the piston rod, wherein an end of the piston rod nut is pivotably connected with the connecting rod, the other end of the piston rod nut is fixedly connected with the piston rod, and wherein the hydraulic chamber body is filled with a resistant fluid.

10. The positionable hidden hydraulic hinge of claim 9, wherein an end of the curved rod is pivotably connected with the fixing base through a pin, and the piston rod nut is pivotably connected with the connecting rod through a pin.

11. The positionable hidden hydraulic hinge of claim 7, wherein the spring is located between the piston rod sealing sleeve and an end of the piston rod that is opposite the end of the piston rod pivotably connected with the connecting rod.

12. The positionable hidden hydraulic hinge of claim 1, wherein the fixing base and the rotatable device body are respectively configured to be capable of being buried in a door frame and a door leaf.

* * * * *